US005655720A

United States Patent [19]

Hixon et al.

[11] Patent Number: 5,655,720

[45] Date of Patent: Aug. 12, 1997

[54] HAMMER MILL WITH IMPROVED COVER LINER ASSEMBLY

[75] Inventors: Larry M. Hixon, Pittstown; Ching-Chung Huang, Summit, both of N.J.

[73] Assignee: Hosokawa Micron International Inc., New York, N.Y.

[21] Appl. No.: 438,078

[22] Filed: May 8, 1995

[51] Int. Cl.[6] ..... B02C 13/06

[52] U.S. Cl. ..... 241/189.1; 241/300

[58] Field of Search ..... 241/189.1, 300, 241/285.2

[56] References Cited

U.S. PATENT DOCUMENTS

| | | | |
|---|---|---|---|
| 2,291,815 | 8/1942 | Korum | 241/88.3 |
| 2,595,810 | 5/1952 | Perry | 241/300 |
| 3,204,881 | 9/1965 | Parten | 241/300 |
| 3,491,815 | 1/1970 | Thompson | 241/73 X |
| 5,526,988 | 6/1996 | Rine | 241/23 |
| 5,558,281 | 9/1996 | Bouldin et al. | 241/51 |

*Primary Examiner*—John M. Husar

*Attorney, Agent, or Firm*—Fitzpatrick, Cella, Harper & Scinto

[57] ABSTRACT

A hammer mill for reducing the size of particles has a generally cylindrical chamber with first and second side walls, cylindrical lower wall portion and an upper wall portion. Plural hammers extend radially from a cylindrical rotatable body mounted in the chamber coaxially therewith. The upper wall portion is divided into a first cylindrical section and a second suction inducing section between the first cylindrical section and a particle inlet. A liner having particle deflectors is slidingly mounted on the first cylindrical section in grooves formed between the upper edges of plates attached to the sidewalls of the chamber and the first cylindrical section of the upper wall portion. A plate liner is positioned at the interior of the second section on angled straight line edges of the sidewall plates to provide a space for suctioning particles from the particle inlet.

12 Claims, 6 Drawing Sheets

HAMMER MILL WITH IMPROVED COVER LINER ASSEMBLY

FIELD OF THE INVENTION

The invention relates to pulverizing of materials and, more particularly, to cover liner assembly arrangements in hammer mill type pulverizers.

BACKGROUND OF THE INVENTION

Hammer mills have long been used to reduce the particle size of materials by repeatedly striking particles with a rotating set of hammers and removing small size particles through a screen. FIG. 1 illustrates the structure of a hammer mill 10 and a feeder 41 for pulverizing according to the prior art. In FIG. 1, hammers 26 disposed radially around wheel 30 are rotated counter-clockwise at high speed causing a counter-clockwise air current. An upper portion 20 of a cover (housing) of the hammer mill has a liner 22 on the interior thereof and a lower portion 32 has a mesh screen 34. Particles introduced into a feeder inlet 12 of the feeder 41 are directed to a hammer mill inlet 18 by screw feeder 16. The introduced particles are swept into a space between outer tips of rotating hammers 26 and the liner 22 by the air current and are successively struck by the hammer tips while moving in the hammer mill so that the size of the particles is reduced. The resulting small size particles exit the hammer mill through the mesh screen 34 while particles too large to fall through the screen 34 return to the space between the hammers and the liner to be struck by the rotating hammers.

The hammer mill liner 22 of FIG. 1 includes deflection sections which deflect particles into the path of the hammer tips and thereby increase the force of hammer impact. FIG. 2 illustrates the action of a deflecting portion of the liner 22 on a path 40 of a particle struck by one of rotating hammers 26. As readily seen from FIG. 2, the path of a particle after being struck by the hammer 26 is controlled to follow the path 40 by the deflecting portion of the liner 22. The deflection sections are shaped so that the struck particle is placed back into the path of the rotating hammers. Without the deflection sections, the particles may be entrained by circulating air flow between the hammer tips and the liner of the cover so that the particles are not restruck by the hammers effectively, In order to assure optimum hammer impact, the angle of the liner deflectors and the spacing between the hammer tips and the liner must be accurately controlled. The liner 22 also includes a portion 24 adjacent to the inlet 18 which is spaced further away from the hammer tips to create suction to draw the particles from the inlet 18 into the mill and prevent blow back of the particles. Since the liner is unavoidably to be struck by particles, it is subject to wear and frequent replacement.

As disclosed in U.S. Pat. Nos. 2,291,815 issued to H. E. Korum Aug. 4, 1942 and 3,491,815 issued Jan. 27, 1970 to E. D. Thompson, it is well known to replaceably secure a mesh screen to a portion a hammer mill or similar apparatus by sliding the screen between circular rings or placing the screen on a circular shaped abutment. In prior art hammer mill structures of the type utilizing liners, the upper portion of the housing has been constructed with a varying radius to provide a portion in which particles are induced into the mill chamber and a portion in which the particles are struck by rotating hammers. As a result, it is difficult to employ a sliding type of attaching structure for liners for accurate positioning in a varying radius housing.

Liners of the prior art have been attached to the interior walls of hammer mill covers by regularly spaced bolts 23.

FIG. 3 illustrates a deflecting type liner attached to the upper portion cover of a hammer mill by regularly spaced bolts. The bolts, however, must be accurately placed and torqued to control both proper spacing and proper deflection angle. Even minor misalignment of the bolts and a liner causes distortion of the liner and results in incorrect spacing and improper deflection angles. Additionally, the bolts are subjected to repeated particle impact so that they wear rapidly and frequent inspection and replacement are required.

BRIEF SUMMARY OF THE INVENTION

The invention is directed to a pulverizing device having a chamber in which plural hammers extending radially from a rotor. The upper wall of the chamber includes a first cylindrical section having a predetermined spacing from the outer head portions of the radially extended hammers and a second section having a larger spacing from the outer tips of the radially extending hammers. At least one liner device disposed on the upper wall of the chamber includes plural deflecting sections facing the radially extended hammers to deflect particles in the chamber to the hammer tips. The at least one liner device covers the first cylindrical section of the upper wall so that the deflecting sections direct particles in the chamber from the liner to head portions of the radially extended hammers.

According to one aspect of the invention, the at least one liner device is supported along its side edges so that it is positioned adjacent to the interior surface of the first cylindrical section of the chamber upper wall.

According to another aspect of the invention, the at least one liner device slides into a position conforming to the first section of the upper wall of the chamber whereby there is a predetermined angular relationship between the plural deflection sections of the liner device and the path of the outer tips of the rotating hammers.

According to yet another aspect of the invention, a thin plate extending from the interior surface of each sidewall of the chamber has an upper edge facing the upper wall of the chamber spaced to provide a narrow groove parallel to the upper cylindrical wall of the chamber. The side edges of the at least one liner device are slidingly mounted in the grooves to conform to the first section of the upper cylindrical wall of the chamber.

According to yet another aspect of the invention, a plate member with or without deflection sections is positioned on the second section of the upper wall of the pulverizing device chamber and one end of the liner adjacent to the second section is interlocked with an end of the plate member to maintain the liner in position in the first section.

According to yet another aspect of the invention, the first cylindrical section of the upper wall of the chamber has a first radius and a first center and the second section of the upper wall of the chamber has a second radius and a second center. The plate member positioned on the wall of the second section includes an interlocking end facing the first section. Side edges of the liner device adjacent to the second section slide in the narrow grooves so that a first end of the liner device interlocks the interlocking end of the plate member in the second section and the liner is fixedly positioned on the first section at a point remote from the first end.

According to yet another aspect of the invention, a plurality of liner devices are successively slid into the narrow grooves of the first section of the upper wall of the chamber so that they interlock with each other and the deflecting portions of the plural inner devices cover the first section.

DETAILED DESCRIPTION

Figure 4:
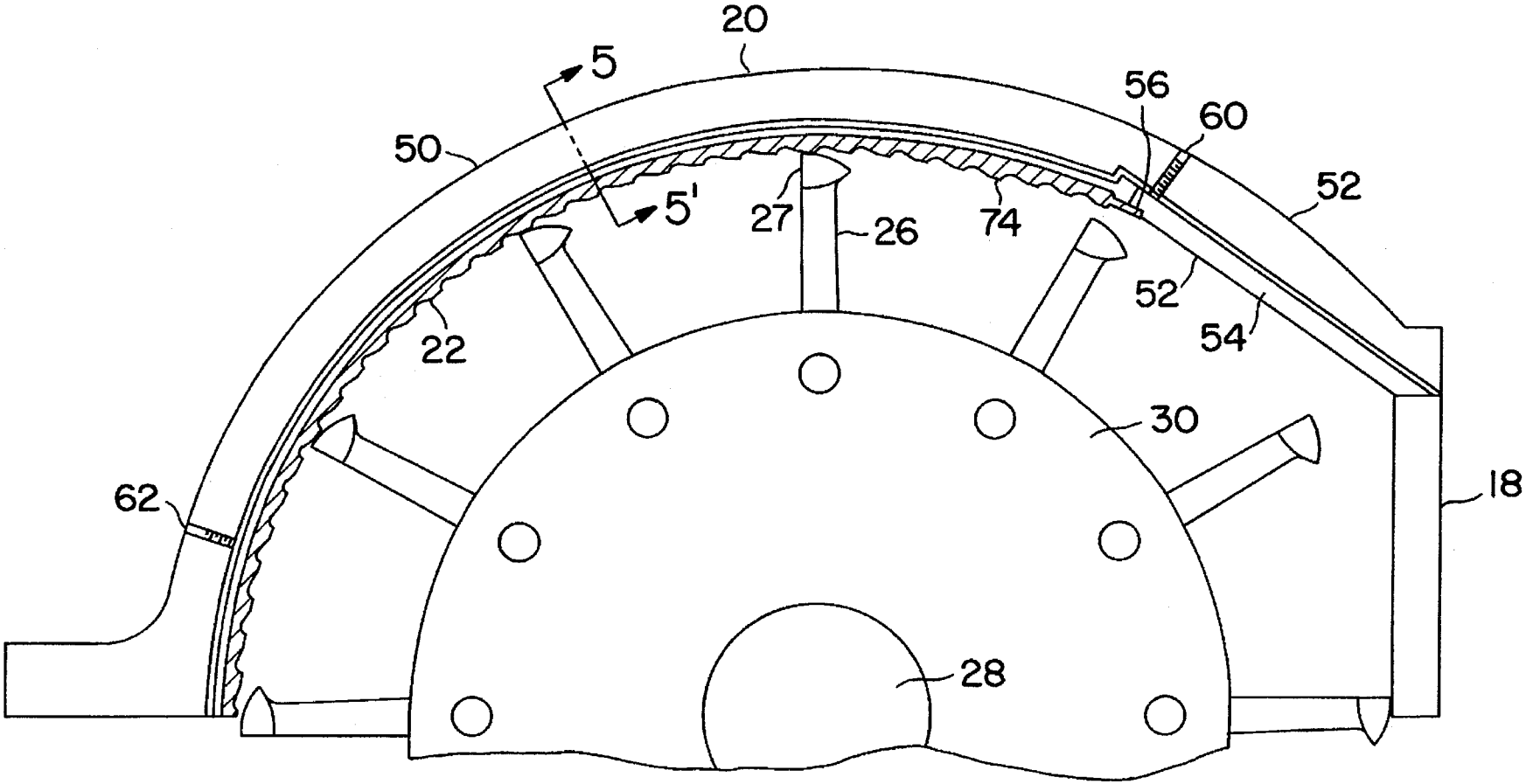
FIG. 4 is a side cross-sectional view of an upper portion of pulverizer with first and second sections illustrative of the invention.

FIG. 4 is a cross-sectional view of the upper portion of a hammer mill that illustrates the liner mounting arrangements of the invention. In FIG. 4, there is shown an upper portion of a pulverizing chamber in which a hammer 26 with a head 27 is pivotally mounted on a wheel 30 which is driven by a drive shaft 28. In operation, the hammers 26 are rotated at high speed so that they extend radially from the 30. A liner 22 is mounted in a first section 50 of the upper wall 20 of the cover and a plate member 54 is mounted in a second section 52 extending between the first section 50 and a particle inlet 18. A pair of set screws 60 secure the plate member 54 against the upper edges of side plates mounted on interior faces of side walls of the chamber at the second section 52 and a pair of set screws 62 secure an end of the liner 22 to the upper edges of the side plates of the first section 50 remote from the plate member 54.

Referring to FIG. 4, the first section 50 of the upper wall 20 of the cover is cylindrical and has a first radius and first center. The second section extends outwardly from an end of the first cylindrical section to operate as a throat section in which vacuum pressure generated by the rapidly rotating hammers induces entry of particles from the particle inlet 18 into the space between the liner 22 and the hammer heads 27. The throat section 52 may be a cylindrical section of a larger radius and different center than the cylindrical section 50. The liner 22 in FIG. 4 has deflecting sections facing the tips of the hammer heads 27 which are spaced a predetermined distance therefrom. The angles made by the deflecting sections are arranged so that particles directed thereto after being struck by a hammer head 27 are redirected to the path of a succeeding hammer head.

Figure 5:
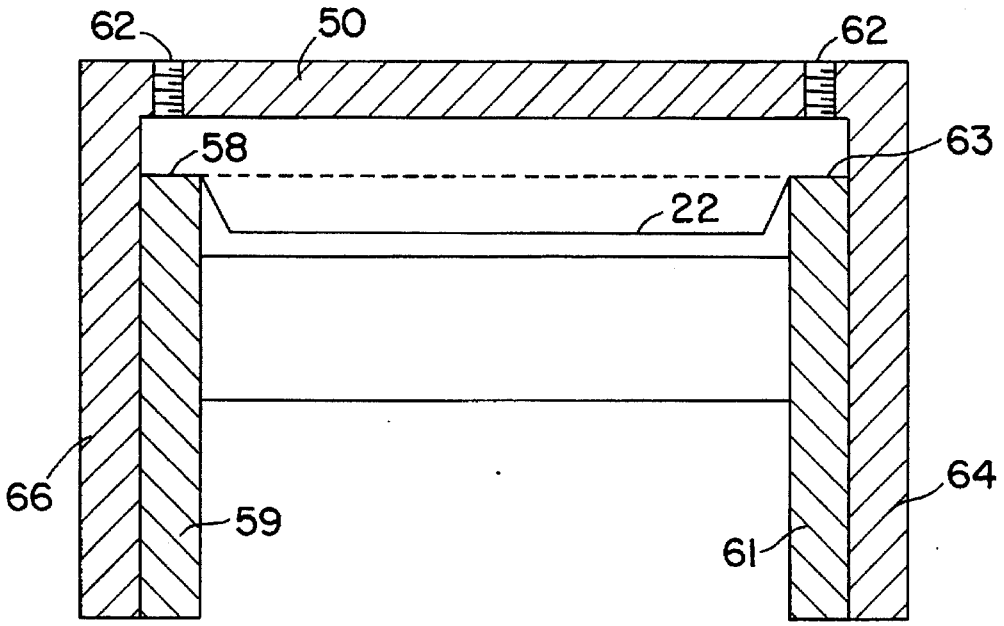
FIG. 5 is a sectional view along lines 5—5' of FIG. 4 illustrating the cover, liner and side plate portions of the pulverizer of FIG. 4.

FIG. 5 shows a view of a section of the upper chamber of FIG. 4 taken along lines 5—5'. Referring to FIG. 5, a thin plate member 59 is attached to one sidewall 66 of the upper portion of the chamber and another thin plate member 61 is attached to the other sidewall 64 of the upper portion of the chamber. The plate member 59 extends into the interior of the chamber and has an upper edge 58 that is parallel to and spaced a predetermined distance from the interior face of first upper cylindrical section 50. Similarly, the plate member 61 extends into the interior of the chamber and has an upper edge 63 that is parallel to and spaced a predetermined distance from the interior face of the first cylindrical section 50. The thin plate members 59 and 61 cooperate with the cylindrical section 50 of upper chamber wall 20 to form relatively narrow grooves along the upper cylindrical section which are adapted to receive the deflecting type liner 22. In addition to providing support for the liner 22, the thin plate members also function as wear plates to protect the side walls 64 and 66 from deterioration as a result of particle contact. The thin plate members may be made of wear resistant materials such as tungsten carbide, ceramic or hardened steel and are replaceable. While thin plate members may be used to form grooves as shown in FIG. 5, it is to be understood that the grooves may be formed in the side walls 64 and 66 adjacent to the interior face of the upper cylindrical section 50.

Figure 9:
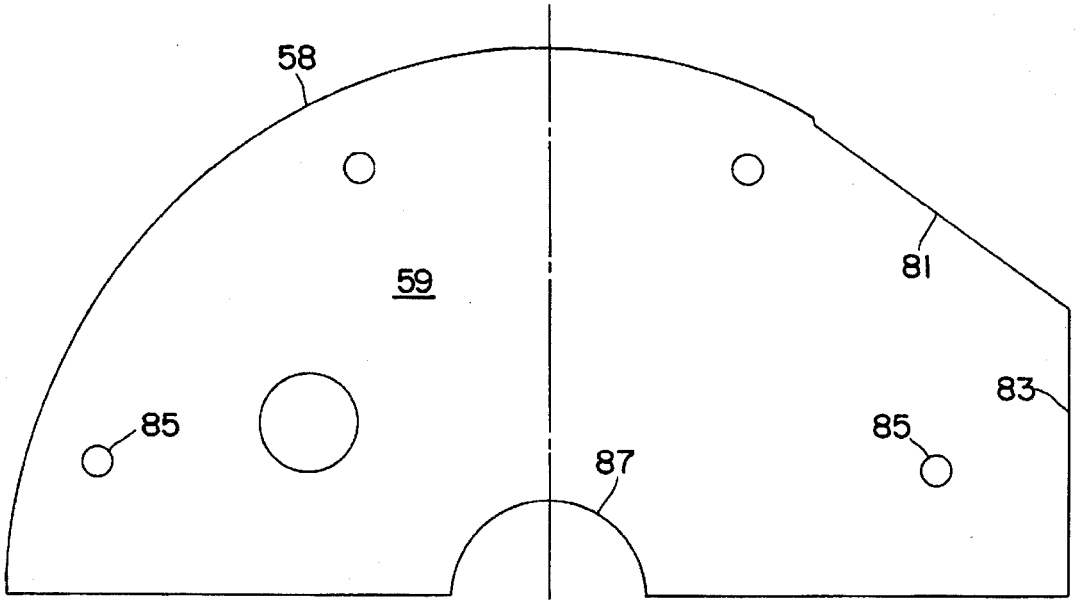
FIG. 9 is a view of one of the side plates shown in FIG. 5.

FIG. 9 depicts a front view of the side plate 59. As shown in FIG. 9, the edge of side plate 59 includes the cylindrical portion 58 in the first cylindrical section 50 of the upper wall, a vertical straight line portion 83 at the inlet portion 18 and an angled straight line portion 81 joining an end of cylindrical edge portion 58 and vertical portion 83. Similarly, the edges of side plate 61 include the cylindrical edge portion 63 in the first cylindrical section 50, a vertical straight line portion corresponding to vertical straight line portion 83 and an angled straight line portion corresponding to angled straight line portion 81.

Figure 10:
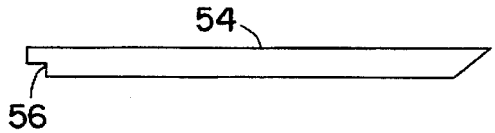
FIG. 10 is a view of a plate member in the second section of the cover.

The plate member 54 shown in FIG. 10 is supported on the angled straight edges of the side plates 59 and 61. The end 56 of the plate member 54 is notched so that the right end of the liner 22 interlocks with the left end of plate member 54. Other interlocking arrangements well known in the art such as angled ends may also be used. The angle of plate member 54 is set so that there is a predetermined distance between the hammer heads 26 and the plate member 54 in the second section located between the first cylindrical section with the deflection sectioned liner 22 and the inlet 18 to create the required suction to draw particles into the chamber from inlet 18. While the plate member shown in FIG. 10 is flat, other shapes may be used and, if desirable, the surface of the plate member may also include the same type of deflection sections as liner 22.

Figure 1:
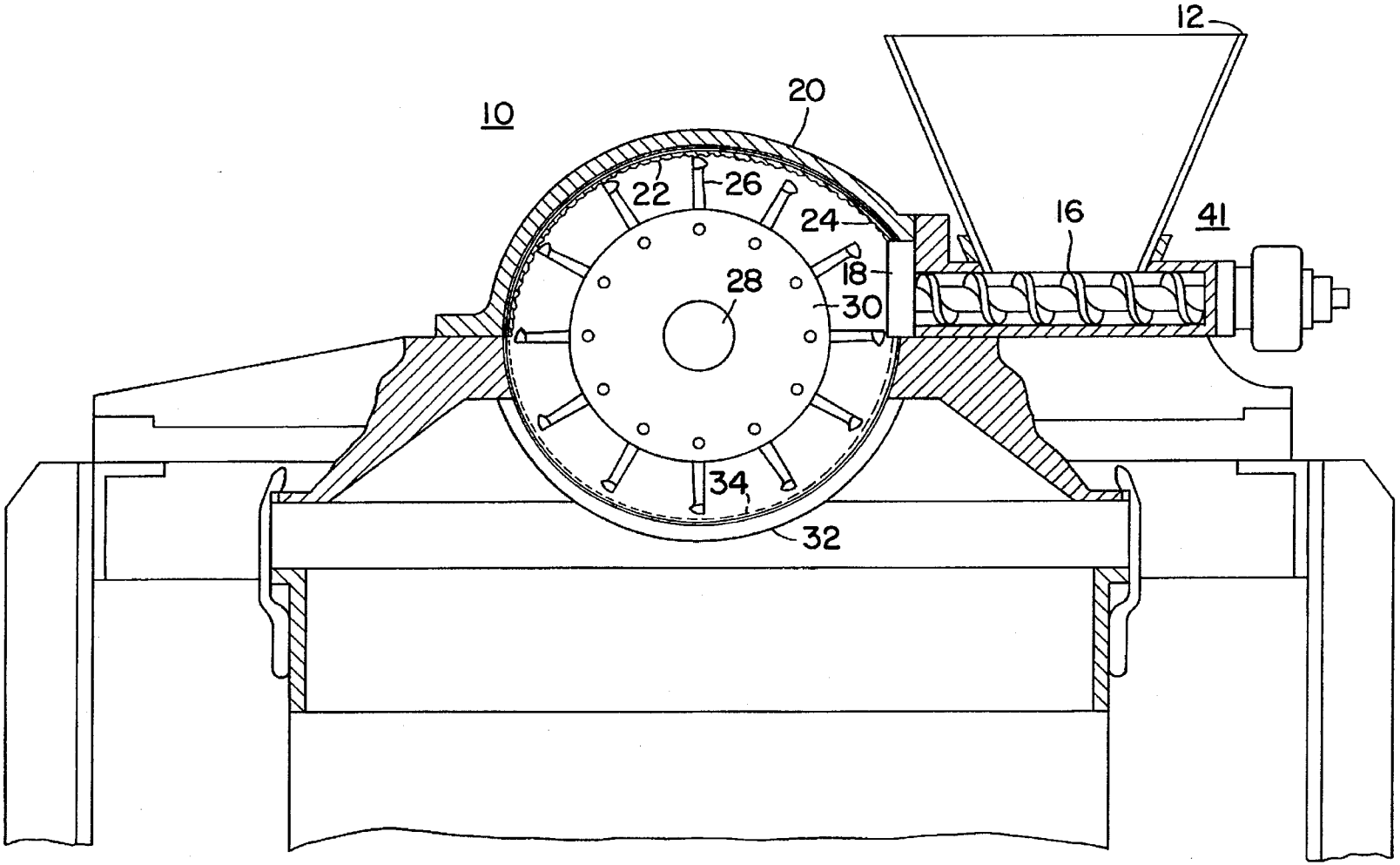
FIG. 1 PRIOR ART
FIG. 1 is a cross-sectional side view of a pulverizer with a particle deflecting liner according to the prior art.
Figure 6:
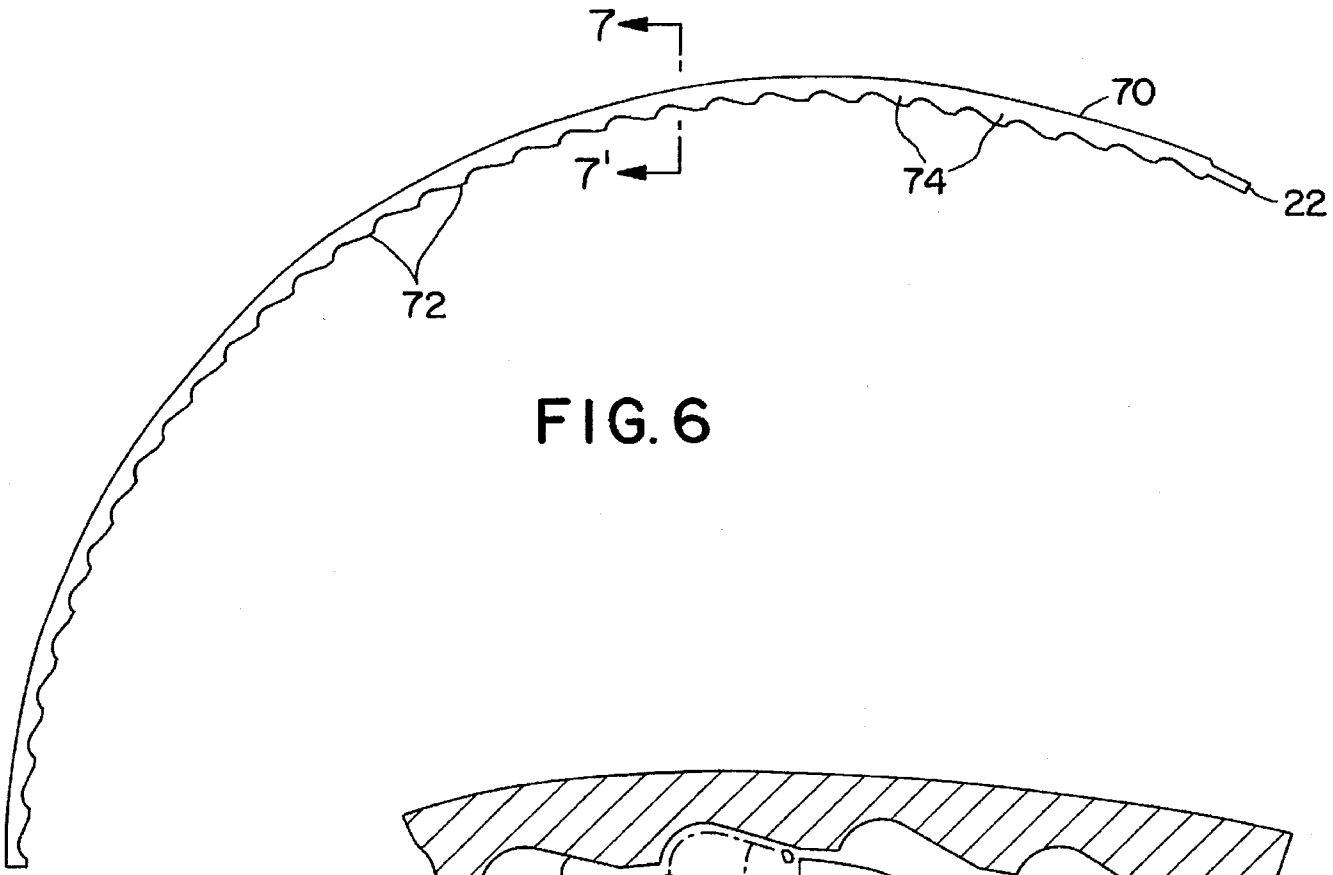
FIG. 6 is a side view of the deflector section of the liner according to the invention.
Figure 2:
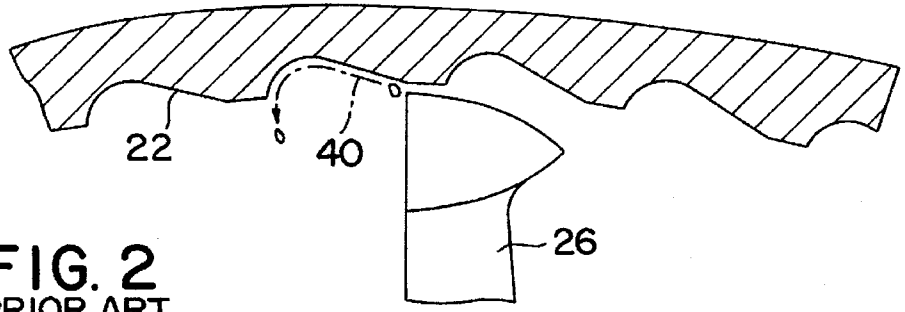
FIG. 2 PRIOR ART
FIG. 2 illustrates the action of a deflecting section of the liner of FIG. 1.

FIG. 6 shows a side view of a liner 22 according to the invention. Referring to FIG. 6, the liner 22 has a substantially rigid cylindrical shape with a convex outer surface 70 and a generally concave inner surface 72 shaped to form deflector sections 74 which must be accurately angled and spaced from the path of tips of the rotating hammer heads 27. When affixed with respect to section 50 of the upper cylindrical wall 20, the deflector sections 74 face the outer tips of the hammers 26 in close proximity thereto. As discussed with respect to FIG. 2, it is necessary to maintain a predetermined distance between the deflector sections 74 and the outer tips of the hammers 26 and to provide a predetermined deflection angle to redirect particles into the path of the hammer heads 27.

Figure 3:
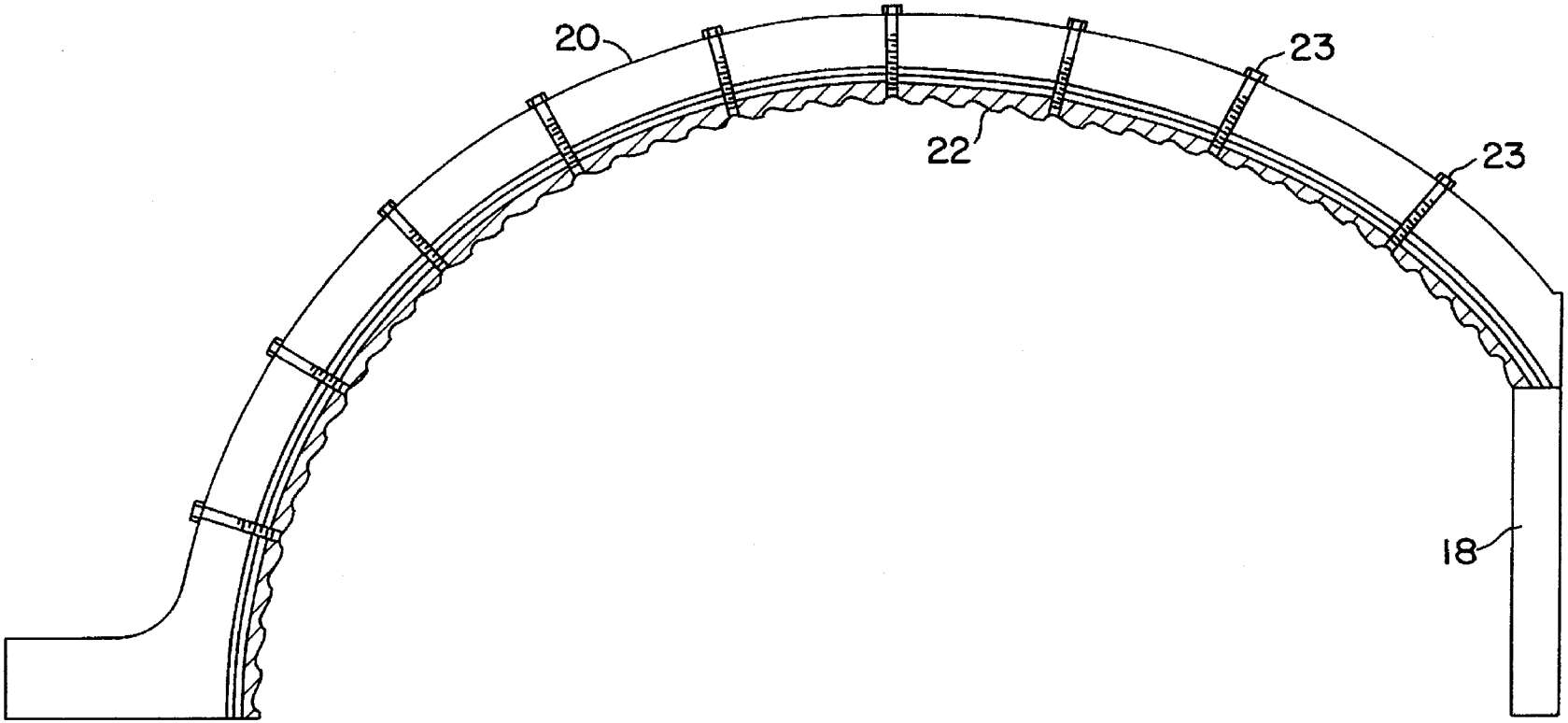
FIG. 3 PRIOR ART
FIG. 3 is a detailed cross-sectional side view of the upper portion of the pulverizer of FIG. 1 illustrating bolt mounting of the liner on the cover according to the prior art.

According to prior art arrangements, a single deflector type liner extends all along the upper chamber wall 20 and is fixedly attached to both cylindrical section 50 and throat section 52 of the upper chamber wall. As a result of the irregular profile of the upper wall of the pulverizing chamber required by the interposition of a vacuum generating throat section between the particle inlet and the cylindrical section, prior art liners have been secured to the upper walls of pulverizing hammer mills by a series of bolts regularly spaced along the liner. As readily seen in FIG. 3, deflection of particles cannot be performed well in the areas in which the bolts are mounted so that the pulverizing efficiency is reduced. The particle impact, however, causes the bolts to be worn out and endangers the integrity of the fastening of the liner to the cover. Further, the force required to secure the liner 22 to the upper wall 20 distorts the deflection sections in the vicinity of each bolt so that the angles of the deflecting sections deviate from the predetermined angles. In order to provide accurate spacing between the deflectors of the liner 22 and the tips of the hammers 26 and an optimum deflection angle, a relatively large number of bolts are required and the bolts must be accurately aligned and tightened. Accordingly, replacement of a liner that is attached by bolts spaced therealong has been a time consuming task requiring skill and care. Additionally, even minor misalignment of the bolts with the corresponding apertures in the liner and cover alters the deflection angles required for particle path control.

In accordance with the invention, the liner is partitioned into a cylindrical deflection section and a suction developing throat section. The deflection liner section 22 has a radius of curvature corresponding to that of the first cylindrical section 50 and is supported only on the upper edges of the side plates 59 and 61 so that deflection angles are accurately maintained and the liner can be rapidly replaced. The throat section 52 of the upper wall 20 may have a flat plate liner 54 or other shaped liner supported on side plates 59 and 61 which is spaced to from the hammer head tips to provide the vacuum creation function of the throat section 52.

Figure 7:
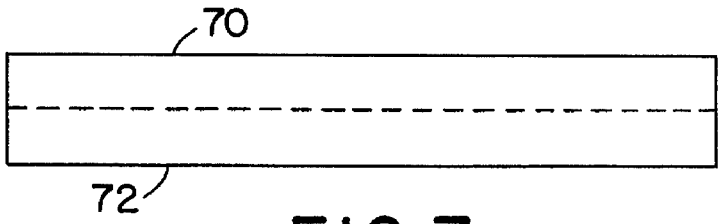
FIG. 7 is a cross-sectional view along lines 7—7' of FIG. 6 showing one type of liner construction.

FIG. 7 shows a cross-sectional view of the liner of FIG. 6 taken along lines 7—7' in which the deflector sections occupy the full width of the liner. According to the arrangement in FIG. 7, the spacing between the upper edges 58 and 63 of the thin plate members 59 and 61 is set so that longer edges of the deflector sections are supported between the interior surface of the first cylindrical section 50 and the upper edges 58 and 63. Since the radius of curvature of the liner 22 is the same as the radius of curvature of plates 59 and 61, the liner 22 readily slides into position in the grooves between the upper edges of plates 59 and 61 and the interior surface of the first cylindrical section to provide deflector sections all along cylindrical section 50. While a single section liner 22 is shown in FIG. 7, it is to be understood that the liner 22 may consist of plural interlocking liner sections that are successively slid into position in the first cylindrical section 50 to provide deflection sections over the entire first cylindrical section.

Figure 8:
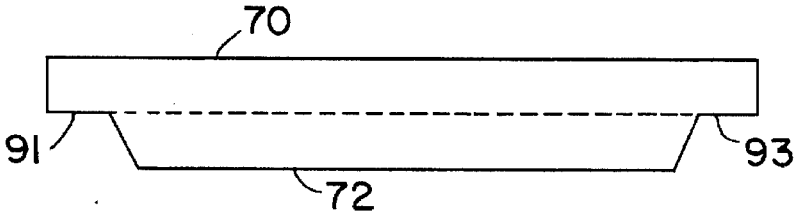
FIG. 8 is a front cross-sectional view along lines 7—7' showing another type of liner construction.

FIG. 8 shows a cross-sectional view of an alternative liner construction in which flat sections 91 and 93 are formed along the side edges of the liner 22. With the alternative construction, the upper edges of thin plate members 59 and 61 are set closer to the interior surface of the first cylindrical section 50 and the liner 22 is supported all along its length rather than periodically by contact with the extended portion of the deflector sections 74.

Referring again to FIG. 4, the flat plate 54 has one end abutting a particle inlet 18 and another notched end 56 abutting the first cylindrical section 50. The set screws 60 pass through threaded apertures in the throat section 52 and press the flat plate 54 against the top edges of the side plates 59 and 61 whereby the flat plate is secured on the interior of the cylindrical section 52. Other attachment arrangements known in the art may be used. The flat plate 54 forms the upper wall of the throat portion of the hammer mill chamber and is secured to the cylindrical section 52 which has a larger radius than cylindrical section 50 and a different center. Deflectors are not required but may be included. The throat liner plate 54 is positioned on the angled straight line edges of side plates 59 and 61 to insure appropriate suction generation.

As best shown in FIG. 5, the deflector liner 22 is held in a position parallel to the interior surface of the first section 50 between the interior surface of the cylindrical section 50 and the upper edge 58 of plate 59. Referring again to FIG. 4, the deflecting portions of the liner 22 face the top of the head portion of the hammer 26 so that there is a predetermined space between the deflecting portions and the top of the head portion 27. Each hammer 26 is mounted on the rotor 30 by means of a pin and extends radially when the rotor is turned by the driver 28. The angles between angled portions of the deflector sections 74 of the liner 22 and the path of the hammer heads are set so that a particle entering the chamber from inlet 18 that is struck by the front portion of one rotating hammer head 27 and diverted to a deflector of the liner is redirected into the path of a succeeding hammer. In order to maintain the efficiency of pulverizing, it is necessary to accurately set the spacing between the hammers 26 and the liner deflectors and the angle of the deflectors with respect to the paths of the hammers. The edge groove mounting according to the invention permits accurate setting of the angles of the deflecting sections without distortion thereof and allows use of the entire surface of the liner for deflection.

In the operation of the hammer mill of FIGS. 4 and 5, the repeated particle impacts cause the liner 22 to wear so that frequent replacement is necessary. As aforementioned, the throat portion of the pulverizer chamber does not extend along the same radius as the cylindrical section 50. In FIG. 4, the cylindrical section 52 adjacent to the particle inlet 18 has a radius that is larger than the radius of section 50 to provide suction and has a different center than that of section 50. According to the invention, the liner portion 22 with deflectors 74 facing the hammers of the hammer mill has the same radius of curvature as that of the grooves formed between edges 58 and 63 and the interior surface of first section 50 of the upper wall 20. The deflecting liner portion 22 is slid into position into a first cylindrical section of the upper wall of the hammer mill having a first radius and center and is held in position by an abutting end of the plate member 54 in the second cylindrical section 52 of the upper wall 20.

As shown in FIG. 5, the side edges of the liner 22 are inserted into the grooves formed between upper edges 58 and 63 of plates 59 and 61, respectively, and the cylindrical section 50 of upper wall 20. The liner 22 is slid so that the first inserted end of the liner 22 fits into the notched end 56 of the throat liner plate 54. The set screws 62 are then threaded through apertures in the cylindrical section 50 to press the liner 22 against the top edges of the side plates 59 and 61 as shown in FIG. 5. The liner 22 is thereby fixedly positioned with respect to the cylindrical section 50 with the deflectors spaced from the tips of the heads of the hammers 26. The deflection angles of the liner 22 are set by the positioning of the liner in the grooves formed between the upper edges 58 and 63 of plates 59 and 61, respectively, and the cylindrical section 50 of upper wall 20 so that the proper deflection angles of the deflectors is set. Advantageously, the time consuming bolt mounting process is replaced by an arrangement in which the deflecting type liner is simply and quickly slid into position and problems of accuracy of the deflection angle and wearing of the mounting bolts are avoided.

Those skilled in the art will recognize that modifications to the foregoing embodiment may be made without departing from the spirit of the present invention. Accordingly, the foregoing description should not be construed as limiting the scope of the invention, which instead should be measured by reference to the following claims.

What is claimed is:

1. A mill for reducing the size of particles of materials comprising:

a housing including first and second side walls, a single piece upper wall portion, and an inlet portion for receiving material particles:

a rotatable body mounted in said housing and coaxial with said housing;

a plurality of hammers extending radially from said rotatable body;

a liner including particle deflectors for deflecting particles to the path of heads of the hammers;

the single piece upper wall portion of the housing including a first cylindrical section which slidingly receives the liner on an interior surface thereof to be held in close proximity to outer surfaces of the hammers and a second section extending outward from an end of the first cylindrical section to the inlet portion for forming a limited space throat portion above the hammers in which vacuum pressure is generated by movement of the hammers to draw particles received by the inlet portion into the first cylindrical section, wherein the upper wall portion of the housing includes a first cylindrical section and a second section extending outward from the first cylindrical section to the inlet portion and the liner is slidingly positioned on the interior surface of the first cylindrical section of the upper wall of the housing.

2. A mill according to claim 1, further comprising a plate member secured to the second section forming an upper bound of the limited space throat portion and having an end attached to the inlet portion and a notched end at the intersection of the first section and the second section, wherein a first end of the liner is slid in grooves in sidewalls of the first cylindrical section to abut against the notched end of the plate member.

3. A mill according to claim 2, wherein the liner is secured to the first cylindrical section of the single piece upper wall of the mill at a point remote from the first end whereby the liner is fixedly positioned along the first cylindrical section of the single piece upper wall with the particle deflectors positioned to deflect particles into the path of the hammers.

4. A mill according to claim 1, wherein the first cylindrical section has a first radius and a first center and the second section is a cylindrical section having a second radius greater than the first radius and a second center to provide the limited space throat portion of the second section, wherein a liner having a notched end is attached to the interior of the second cylindrical section to form an upper bound of the throat portion and an end of the liner of the first cylindrical section is slidingly positioned to abut the notched end of the liner of the second cylindrical section.

5. A mill according to claim 1, wherein the liner comprises a plurality of interlocked liner portions each including particle deflectors for deflecting particles to the path of heads of the hammers.

6. A hammer mill for pulverizing particles comprising:

a chamber including a single piece upper portion having a first cylindrical section of a first radius and center and a second cylindrical of a larger second radius and a second center extending from an end of the first cylindrical section and a particle inlet and a pair of sidewalls joined to the single piece upper portion;

a plurality of hammers extending radially from a rotor centered in the chamber;

a plate attached to an interior face of each sidewall, an upper edge of each of the plates being parallel to and spaced a predetermined distance from the first cylindrical section of the upper portion; and a liner slidingly mounted by side edges thereof between the interior face of the first cylindrical section and the plates, said liner including plural deflectors facing outer portions of the hammers, wherein the second larger radius and different center cylindrical section is positioned above the hammers to form a limited space between an interior face of the second cylindrical section and the hammers in which vacuum pressure is generated to draw particles from the particle inlet into the first cylindrical section.

7. A mill according to claim 6, further comprising a plate member secured to the interior of second section to form a upper boundary of the throat portion and having an end attached to the particle inlet and a notched end at the intersection of the first cylindrical section and the second cylindrical section, wherein side edges of the liner slide into a space between the upper edges of the plates and the first cylindrical section of the single piece upper portion until a first end of the liner abuts against the notched end of the plate member.

8. A mill according to claim 7, wherein the liner is secured to the edges of the sidewall plates at a point remote from the first end whereby the liner is fixedly positioned along the first cylindrical section of the single piece upper portion with the particle deflectors positioned to deflect particles into the path of the hammers.

9. A mill according to claim 6, wherein the liner comprises a plurality of interlocked replaceably mounted liner portions each including particle deflectors for deflecting particles to the path of heads of the hammers.

10. A mill for reducing the size of particles of materials comprising:

a housing including first and second side walls, single piece upper wall portion, and an inlet portion for receiving material particles, the single piece upper wall portion of the housing includes a first cylindrical section and a second suction inducing section extending from the first section to the inlet portion:

a cylindrical rotatable body mounted in said housing and coaxial with said housing;

a plurality of hammers extending radially from said rotatable body;

a pair of grooves formed between the first and second side walls and an interior face of the first cylindrical section, each groove having a predetermined radius of curvature; and a liner of a relatively rigid material including a particle deflecting surface facing a path of heads of the hammers, a radius of curvature of the liner matching the radius of curvature of the grooves whereby the liner slides into said grooves along the interior face of the first cylindrical section, wherein the suction inducing section comprises a second cylindrical section of a different radius and different center than the first cylindrical section for forming a limited space throat portion above the hammers such that vacuum pressure is generated by movement of the hammers draws particles from the inlet portion into the first cylindrical section.

11. A mill according to claim 10, wherein another liner having a notched end at the intersection of the first and second cylindrical sections is secured at the interior of the second cylindrical section and an end of the liner is slidingly positioned to abut the notched end of the another liner.

12. A mill according to claim 10, wherein the liner comprises a plurality of interlocked liner portions each having a radius of curvature matching the radius of curvature of the grooves, said liner portions including particle deflectors for deflecting particles to the path of heads of the hammers.

* * * * *